United States Patent [19]

Ogawa et al.

[11] Patent Number: 4,460,650

[45] Date of Patent: Jul. 17, 1984

[54] ACRYLONITRILE FIBERS, A PROCESS FOR PRODUCING ACRYLONITRILE FIBERS, AS WELL AS PRODUCING PEROXIDIZED FIBERS, FIBROUS ACTIVE CARBON OR CARBON FIBERS THEREFROM

[75] Inventors: Hiroyasu Ogawa; Kazuo Izumi; Kenzi Shimazaki, all of Shizuoka, Japan

[73] Assignee: Toho Beslon Co., Ltd., Tokyo, Japan

[21] Appl. No.: 452,489

[22] Filed: Dec. 23, 1982

[30] Foreign Application Priority Data

Dec. 24, 1981 [JP] Japan ..... 56-214088
Dec. 24, 1981 [JP] Japan ..... 56-214089

[51] Int. Cl.[3] ..... B32B 9/00; B32B 15/00; D01F 9/12; D02G 3/00

[52] U.S. Cl. ..... 428/389; 423/447.5; 428/367; 428/394

[58] Field of Search ..... 428/367, 375, 394, 389; 423/447.5, 447.7; 8/115.6; 427/434.6; 264/29.2

[56] References Cited

U.S. PATENT DOCUMENTS 4,197,279 4/1980 Saito et al. ..... 423/447.5 X
4,237,109 12/1980 Hiramatsu et al. ..... 423/447.5

FOREIGN PATENT DOCUMENTS 1029867 5/1966 United Kingdom ..... 423/447.5
1301101 12/1972 United Kingdom ..... 423/447.5

*Primary Examiner*—Lorraine T. Kendell
*Attorney, Agent, or Firm*—Sughrue, Mion, Zinn, Macpeak and Seas

[57] ABSTRACT

Acrylonitrile fibers suitable for production of preoxidized fibers, fibrous active carbon and carbon fibers, which have thereon a water-soluble basic aluminum salt of the formula:

$$Al_2(OH)_l(A)_m(B)_n(C)_p(Cl)_q \quad (I)$$

where (1) A, B and C stand for mutually different acid residues;

(2) l and q are both an integer or decimal fraction larger than 0;

(3) m, n and p are 0 or an integer or decimal fraction and make a total which is not zero;

(4) $l+mEm+nEn+pEp+q=6$ (Em, En and Ep are the valence numbers of A, B and C, respectively);

$$0.4 \leqq \frac{1}{l+m+n+p+q} \leqq 0.9; \quad (5)$$

in an amount of 0.005 to 5.0% by weight of aluminum element based on the fiber having the salt.

13 Claims, 4 Drawing Figures

ACRYLONITRILE FIBERS, A PROCESS FOR PRODUCING ACRYLONITRILE FIBERS, AS WELL AS PRODUCING PEROXIDIZED FIBERS, FIBROUS ACTIVE CARBON OR CARBON FIBERS THEREFROM

FIELD OF THE INVENTION

The present invention relates to acrylonitrile fibers suitable for production of a preoxidized (flame-retardant) fibers, fibrous active carbon or carbon fibers. The invention also relates to a process for producing these fibers from the acrylonitrile fiber.

BACKGROUND OF THE INVENTION

Preoxidized fibers are prepared by preoxidizing acrylonitrile fibers. Due to the flame retardancy of such fibers they are used in fire-proof jackets, flame-proof curtains and packing materials, or as starting materials for fibrous active carbon and carbon fibers. Conventional preoxidized fibers are described in U.S. Pat. Nos. 3,285,696 and 3,412,062. In order to make use of preoxidized fibers they must be fabricated into yarn, fabric or felt. However, preoxidized fibers are inherently difficult to crimp. Accordingly, when they are fabricated into yarn, many filaments break greatly reducing the fabrication efficiency. When the fibers are subjected to a felting process, considerable fiber shedding occurs, so that the yield and strength of the final products are decreased.

Fibrous active carbon, the demand for which is increasing these days, is produced by carbonizing and activating the preoxidized fiber. Then it is formed into a tow, fabric or felt and employed for example, in a solvent recovery apparatus as an adsorbent or filter. Because of the unique adsorption capacity and high mechanical strength due to the presence of nitrogen atoms, the fibrous active carbon made of the acrylonitrile fiber is expected to have many utilities. In order to produce felt, fabric and yarn of active carbon fiber, preoxidized fibers obtained from acrylonitrile fiber are first made in the form of felt, fabric or yarn, and then activated. Alternatively, preoxidized fibers are first activated and then using the thus-obtained fibrous active carbon felt, fabric and yarn are produced. When the fibrous active carbon is processed into a felt, fabric or yarn, it must have adequate strength and crimpability. Both factors depend on the characteristics of the preoxidized fiber. This means that the preoxidized fiber must have sufficiently high strength and crimpability to withstand the subsequent fabrication. However, as mentioned above, the preoxidized fiber is difficult to crimp and cannot be fabricated into a yarn without causing substantial filament breakage. Furthermore, when it is needle-punched to make a felt, a considerable amount of the material is lost as fluff. Therefore, the yield and strength of the final product are greatly reduced. In the conventional preoxidation method, a tow of acrylonitrile fibers is subjected to significantly long heat treatment at low temperatures. This effectively inhibits sudden heat generation and retains the high spreading ability of the fibers. It is also effective in preventing the reduction in the fiber strength. However, the improvement in the overall characteristics of the fiber is far from satisfactory. As a further disadvantage, the long heat treatment accounts for as much as 80% of the total time for producing the fibrous active carbon. This makes the active carbon expensive.

As a result of various studies to solve these problems the present inventors have found that the desired preoxidized fiber can be efficiently produced by depositing a water-soluble basic aluminum salt on acrylonitrile fibers. Further, fibrous active carbon or carbon fiber of high quality can be produced in a high yield from the resulting acrylonitrile fiber.

SUMMARY OF THE INVENTION

One object of the present invention is to provide acrylonitrile fibers capable of forming a preoxidized fibers, fibrous active carbon or carbon fibers having good processability.

Another object of the invention is to provide a method for producing the acrylonitrile fibers and an efficient process for producing a preoxidized fiber of good processability or for preparing a fibrous active carbon or carbon fiber of good processability from the acrylonitrile fiber.

The acrylonitrile fiber according to the present invention has thereon a water-soluble basic aluminum salt of the formula:

$$Al_2(OH)_l(A)_m(B)_n(C)_p(Cl)_q \quad (I)$$

where (1) A, B and C stand for mutually different acid residues;

(2) l and q are both an integer or decimal fraction larger than 0;

(3) m, n and p are 0 or an integer or decimal fraction and make a total which is not zero;

(4) $l+mEm+nEn+pEp+q=6$ (Em, En and Ep are the valence numbers of A, B and C, respectively);

$$0.4 \leqq \frac{l}{l+m+n+p+q} \leqq 0.9; \quad (5)$$

in an amount of 0.005 to 5.0% by weight of aluminum element based on the fiber having the salt.

DETAILED DESCRIPTION OF THE INVENTION

Figure 1:
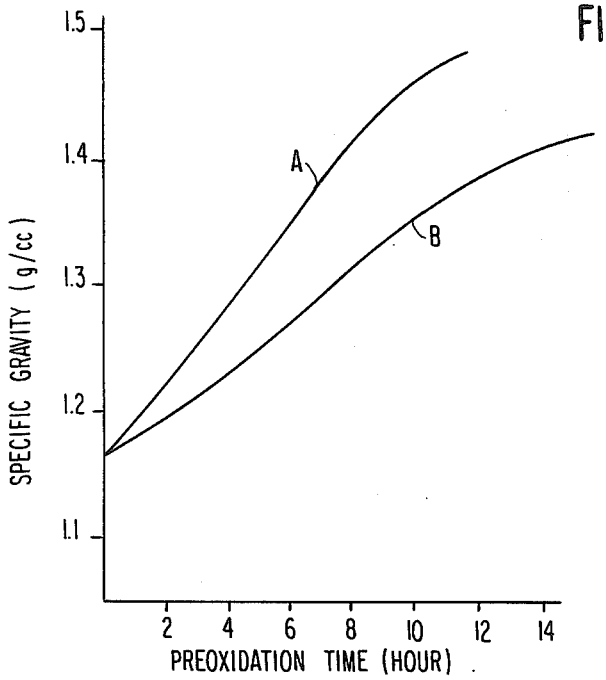
FIG. 1 shows the relation between the specific gravity of the treated acrylonitrile fibers of the present invention and the preoxidation time at 230° C.

The acrylonitrile fibers to be used in the present invention are comprized of a homopolymer, copolymer, homopolymer/copolymer mixture, or a mixture of two or more copolymers containing not less than 85 wt% of acrylonitrile. Illustrative comonomers include (1) acrylic acid and methacrylic acid, (2) their salts (such as Na, Ca, Mg and Ca salts), esters (such as methyl or ethyl ester), acid chlorides, acid amides, and n-substituted derivatives of the acid amides (example for substituents include methyl, ethyl, propyl, butyl, hydroxyethyl, hydroxypropyl and hydroxybutyl); (3) vinyl chloride, vinylidene chloride, α-chloroacrylonitrile and vinyl pyridines; (4) vinylsulfonic acid, allylsulfonic acid, vinylbenzenesulfonic acid and their alkali metal salts (e.g. Na and K salts) and alkaline earth metal salts (e.g. Ca, Mg and Zn salts).

The molecular weight of these polymers may be of any value if they are capable of forming fibers, and usually, it ranges from 50,000 to 150,000.

There is no particular limitation on the fineness of acrylonitrile fiber used in the present invention, but a fineness of 0.5 to 15, especially 1.0 to 5 denier (d), is preferred. If the fiber is finer than 0.5 d, the fiber will be weak and may easily break while it is processed. If the fiber is thicker than 15 d, its preoxidation rate is low and only fibrous active carbon that is low in tensile strength, elasticity and yield of activation can be produced therefrom. The acrylonitrile fiber used in the present invention can be prepared by known methods which are described in U.S. Pat. Nos. 2,558,732, 2,404,714, 3,135,812 and 3,097,053 (incorporated herein by reference to disclose such methods).

The water-soluble, basic aluminum salt has the formula: $Al_2(LH)_l(A)_m(B)_n(C)_p(Cl)_q$, and in this formula A, B and C represent different acid residues which include inorganic acid residues such as nitric acid, nitrous acid, sulfuric acid, phosphoric acid and phosphorous acid. If $l/l+m+n+p+q$ is smaller than 0.4, the salt is highly soluble in water but it cannot provide the preoxidized fiber with the desired crimpability. If that index is greater than 0.9, no stable aqueous solution that can be uniformly deposited on the acrylonitrile fiber is obtained. Specific examples of the water-soluble basic aluminum salt that can be used in the present invention include:

(1) $Al_2(OH)_{2.5}NO_3Cl_{2.5}$
(2) $Al_2(OH)_5(SO_2)_{0.25}Cl_{0.5}$
(3) $Al_2(OH)_{2.8}(SO_4)_{0.8}Cl_{1.6}$
(4) $Al_2(OH)_{2.7}(SO_4)_{0.26}Cl_{2.78}$
(5) $Al_2(OH)_{2.7}(SO_4)_{0.26}(PO_4)_{0.3}Cl_{1.88}$
(6) $Al_2(OH)_{2.65}(NO_3)_{0.05}(SO_4)_{0.1}(PO_4)_{0.1}Cl_{2.80}$
(7) $Al_2(OH)_3Cl_3$

These salts satisfy the requirements stated above, and the data for salt (3) used in Example 2 to be given hereunder and that for salt (6) used in Example 3 listed below.

| | Salt (3) | Salt (6) |
|---|---|---|
| $l + m \cdot Em + n \cdot En + p \cdot Ep + q$ | 6.0 | 6.0 |
| $l/l + m + n + p + q$ | 0.538 | 0.465 |

If the treated acrylonitrile fiber of the present invention is used in the production of fibrous active carbon, it is particularly preferred that a water-soluble basic aluminum salt of the following formula be used:

$$Al_2(OH)_l(PO_4)_mCl_q$$

wherein $l+3m+q=6$, and $0.4 \leqq l/l+m+q \leqq 0.9$. Examples of the salt having the above identified formula include (1) $Al_2(OH)_{2.7}Cl_{2.1}(PO_4)_{0.4}$,
(2) $Al_2(OH)_{2.1}Cl_{2.4}(PO_4)_{0.5}$,
(3) $Al_2(OH)_{2.8}Cl_{1.7}(PO_4)_{0.5}$ and
(4) $Al_2(OH)_{2.8}Cl_{1.7}(PO_4)_{0.5}$.

The water-soluble basic aluminum salt is typically prepared by the following method: aluminum chloride is mixed with at least one aluminum salt selected from among aluminum sulfate, aluminum nitrate and aluminum phosphate, and optionally with aluminum powder, and the mixture is rendered into a solution or slurry, to which an alkaline compound (e.g. $NH_4OH$, $NaHCO_3$, KOH or NaOH) is added and the resulting mixture is heated at 80°–200° C. Methods for production of the salts are described in detail in, for example, U.S. Pat. Nos. 2,493,262, 2,876,163, 3,929,666, 3,925,428, 3,927,184 and 4,131,545, Japanese Patent Publication (OPI) (The term "OPI" as used herein refers to a "published unexamined Japanese Patent Publication) 130,387/74, 12,000/75, 153,799/75, 29,479/75, 128,694/76, 66,299/76, 18,998/76 and 9,699/77. The salts specified in Japan Waterworks Standard JWWA-K114 and Japanese Industrial Standard K 1475-1978 may also be used in the present invention.

The above described salt is deposited on an untreated acrylonitrile fiber in an amount of 0.005 to 5.0, preferably 0.05 to 3.5 wt%, with respect to the amount of aluminum element present, on the basis of the weight of the treated acrylonitrile fiber, i.e., the fiber after salt deposition. If more than 5 wt% of Al element is deposited on the acrylonitrile fiber, a sufficiently strong preoxidized fiber is not obtained, and if less than 0.005 wt% of Al element is used, the preoxidized fiber is not given the desired crimpability and no reduction in the preoxidation time is realized.

The salt can be deposited on the acrylonitrile fiber by immersing the fiber in an aqueous solution of the salt or spraying it with said solution during spinning of acrylonitrile fiber or prior to subjecting the fiber to preoxidation. The concentration of the aqueous solution is preferably between 0.03 wt% and 10 wt%. The solution need not be heated before the deposition step but preferably is performed at about from 5° to 60° C., and which is usually effected at room temperature. The immersion is usually conducted for a period of from 10 seconds to 30 minutes. After the deposition, the treated fiber may be immediately subjected to preoxidation, but if necessary, it may be dried at a temperature which is generally not more than 150° C. To promote drying, the aqueous solution of the salt may contain ethanol or acetone in such an amount that the salt will not be precipitated.

The acrylonitrile fiber coated with the salt may be preoxidized by a conventional method, wherein it is preoxidized by a conventional method, wherein it is heated at a temperature between 200° and 400° C., preferably between 225° and 350° C., in an oxidizing atmosphere such as air, oxygen, or sulfurous acid gas solely or in admixture with hydrogen chloride or an inert gas. The most effective concentration of oxygen in the oxidizing atmosphere is in the range of 0.2 to 35 vol%. The preoxidation is preferably divided into two stages, and the first stage until the specific gravity of the fiber becomes 1.21–1.30 may be effected in a medium having an oxygen concentration of 20 to 35 vol%, and the second stage in a medium having an oxygen concentration of 0.5 to 9 vol%. The oxidation period ranges from 0.5 to 30 hours, preferably 1.0 to 10 hours. The oxidation is preferably effected until the specific gravity of the fiber is increased to about 1.30 to 1.50, more preferably (for producing fibrous active carbon) about 1.37 to 1.47. If the degree of oxidation is such that the specific gravity of the fiber is less than 1.30, the resulting fiber does not have high flame retardancy and when it is processed into fibrous active carbon, it easily breaks and the yield of activation is decreased. If the degree of oxidation exceeds 1.50 g/ml, the resulting fiber has low strength and frequently breaks during the crimping step. During the preoxidation step, the fiber is preferably held under such tension that it shrinks by about 70 to 90% of the free shrinkage at the oxidation temperature. The tension to meet this requirement is from 0.01 to 0.3 g/d. If the fiber is placed under strong tension such that the shrinkage is less than 70% of the free shrinkage, the fiber bundle tends to be untidy and may break easily. If the shrinkage is more than 90% of the free shrinkage, the mechanical characteristics of the fiber are impaired to make it brittle. The term "free shrinkage" as used herein means the ratio of the shrinkage of a fiber at a given temperature under a load of 1 mg/d as against the initial length. The process of the present invention may be combined with a technique by which the shrinkage is kept at 20–50% until the specific gravity of the fiber becomes 1.21 or with steaming the preoxidized fiber at 100°–150° C. for 1 to 60 minutes. By so doing, a preoxidized fiber having increased elongation and spinnability can be produced.

The basic aluminum salt used in the present invention contains a hydroxyl group and is water-soluble, so not only can it be deposited uniformly on the acrylonitrile fiber but it also effectively absorbs the heat generated during the oxidation of the fiber. Therefore, excessive heat accumulation or temperature build-up is effectively avoided to produce a uniformly oxidized fiber which is also given good crimpability.

The process of the present invention has the following advantages: (1) It is capable of performing preoxidation of a bundle of acrylonitrile fibers in a higher temperature than that of conventional methods without burning them. This greatly shortens the oxidiation period. Generally, the process of the present invention enables the use of an oxidation temperature about 20°–50° C., higher than a process that does not use the water-soluble basic aluminum salt defined hereinabove, and the oxidation period can be reduced by half; (2) The oxidation rate at a definite temperature is larger than that of the fiber having no basic aluminum salt; (3) The process of the present invention provides a preoxidized fiber having higher strength and crimpability than that obtained by the conventional method; (4) The process can produce fibrous active carbon by a shorter activation period and in an improved activation yield; (5) The resulting fibrous active carbon has higher strength and adsorption capacity and better processability. In short, the process of the present invention is capable of very efficient production of a preoxidized fiber having good quality.

As is generally observed, the initial elongation of an acrylonitrile fiber under preoxidation is decreased with the progress of oxidation, and if the fiber is subjected to sufficient oxidation to render it flame-retardant, the reduced elongation impairs the spinnability of the fiber, with the result that frequent fiber breakage or considerable fiber shedding occurs. Similar troubles are apt to occur in the active carbon yarn that is prepared by activating the spun preoxidized fiber. The preoxidized fiber may be needle-punched to form a felt, but due to the defects mentioned above, the yield of the felt is not satisfactory. Conventionally, spinnability and other processing characteristics of the preoxidized fiber are increased by minimizing the reduction in elongation at the expense of the rate of oxidation and heat stability, but this method also sacrifices the flame retardancy of the resulting fiber.

As a result of further study on the acrylonitrile fiber that has high heat resistance and flame retardancy and good processability such as spinnability, we have found that the desired preoxidized fiber that can be spun into yarn without filament breakage or fiber shedding can be produced. Such a fiber is produced by depositing on an untreated acrylonitrile fiber the water-soluble basic aluminum salt containing P element together with an iron compound or with an iron compound and a phosphorous compound (other than said aluminum salt). In the latter case a basic aluminum salt containing no P element may be used. More specifically, the intended object can be attained by depositing aluminum, phosphorous and iron elements on an acrylonitrile fiber.

Aluminum ions in aqueous solution are apt to form a cationic macromolecular colloid, and this neutralizes the negative charge on the surface of the fiber to thereby form a thin aluminum compound coat on the fiber surface. This is probably effective in inhibiting the individual fibers from coalescing to each other during preoxidation. An aluminum salt is preferably deposited on the acrylonitrile fiber in an amount of 0.005 wt% to 0.05 wt% more preferably 0.01 to 0.03 wt% in terms of the amount of the aluminum element present on the basis of the weight of the treated acrylonitrile fiber (i.e., the fiber after deposition). If less than 0.005 wt% of the aluminum element is used, the desired effect to inhibit the coalescence of fiber surface is not sufficiently exhibited to provide a preoxidized fiber having improved elongation. If more than 0.05 wt% of the aluminum element is deposited, coalescence of fibers also occurs and the resulting fiber has low strength and elongation.

The iron element is also effective in preventing the fibers from coalescence to each other. However, if the iron element is used alone, the composition of the deposition bath is unstable and leave speckles on the fiber surface, or the resulting preoxidized fiber has a large core (the unoxidized central part) and exhibits low strength and elongation. In the presence of the Al and P elements, an iron compound proves very effective if it is used in an amount of 0.0005 to 0.01 wt%, preferably 0.001 to 0.007 wt%, with respect to the amount of iron element(hereinafter referred to "Fe element"). If less than 0.0005 wt% of the iron element is used, the intended effect of inhibiting the fibers from coalescing to each other is not exhibited, and if more than 0.01 wt% is used, its effect inhibiting coalescence of fibers to each other is also impaired.

In contrast to the Al and Fe compounds, a phosphorous compound used alone promotes, rather than prevents, the coalescence of fibers to each other. But in the presence of aluminum and iron elements, the P element enhances their ability to inhibit the coalescence of fibers to each other, further reduces the unevenness in the flame retardancy of the fiber in radial direction, and further improves its flame retardancy. The P compound (aluminum chloride complex salt and/or a compound other than the salt) is preferably used in an amount of 0.005 to 0.1 wt%, more preferably from 0.008 to 0.07 wt%, with respect to the amount of phosphorous element (hereinafter referred to "P element"). If less than 0.05 wt% of the P element is used, its effectiveness in furnishing the fiber with flame retardancy is decreased. If more than 0.1 wt% of of the P element is used, there occurs a sudden increase in the number of fibers that are coalesced to each other during oxidation.

Depending on the type of the aluminum salt, iron compound and phosphorous compound, as well as the manner in which they are combined, an agglomerate of Al and Fe may form when these compounds are brought into aqueous solution, and this undesirably leads to the production of a preoxidized fiber with reduced elongation. Therefore, the proportions of these compounds should be so selected that a stable aqueous solution free from such agglomerate is formed on the condition that they are used in amounts within the range specified above. Preferred examples of proportions of the three elements are listed in Table A below wherein the figures are indicated in wt%. A stable aqueous solution can be prepared from either the aluminum salt containing phosphorous element(s) or from a separate phosphorous compound (other than the salts), so long as it is contained in one of the proportions indicated in Table A.

TABLE A

| Al | Fe | P |
|---|---|---|
| 65 | 3 | 32 |
| 44 | 11 | 45 |
| 35 | 12 | 53 |
| 65 | 12 | 23 |
| 51 | 13 | 36 |

Figure 2:
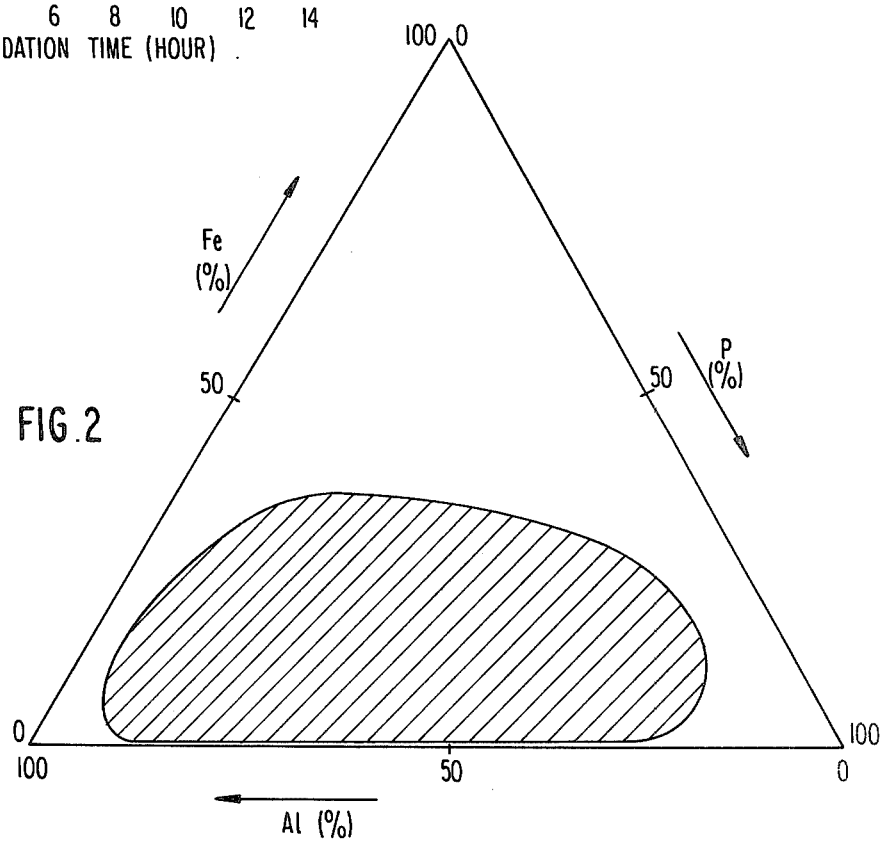
FIG. 2 is a graph showing the preferred composition range of Al-Fe-P to be deposited on the acrylonitrile fibers.

When $Al_2(OH)_{2.99}Cl_{1.93}(SO_4)_{0.54}$, $H_3PO_4$ and $Fe_2(SO_4)_3$ are combined, a very stable aqueous solution that is free from the Al-Fe agglomerate can be prepared if the proportions of the three compounds are included in the hatched area of the graph of FIG. 2.

When a compound having a P-containing acid residue such as phosphoric acid residue or phosphorous acid residue is used as the aluminum salt, no additional phosphorous compound need be used so long as the P content is is included in the above specified range, but if necessary, the P element may be supplemented with another phosphorous compound. The phosphorous compound has such an advantage that the phosphorous element accelerates activation reaction of a preoxidized fiber, so it may be additionally deposited on the fiber after preoxidation. In this case, the total of the phosphorous and aluminum elements deposited on the fiber is preferably from 0.04 to 1 wt% and 0.005 to 10 wt%, respectively.

The iron compound used in the present invention is water-soluble and preferred examples are ferric and ferrous chlorides, ferric and freeous nitrates and ferric and ferrous sulfates. The phosphorous compound used in the present invention is water-soluble and preferred phosphorous compounds are orthophosphoric acid, hypophosphorous acid and phosphorous acid.

Generally, the elongation of an acrylonitrile fiber is decreased when it is oxidized to become flame-retardant, but by using Al, Fe and P elements in the manner described above, preoxidized fiber having good performance such as a limit oxygen index (LOI) of 45 or more and an elongation of 20% or more can be produced in high yield. The limit oxygen index of a fiber is determined by the following method according to JIS K 7201. Wind about 1 g of a test sample about a metal wire (ca. 0.3 mmΦ) to form a stringlike product (ca. 7 mmΦ). Fasten the product to a frame 150 mm high and place it within a combustion cylinder. Supply an oxygen-nitrogen mixture into the cylinder at a rate of 11.4 l/min for about 30 seconds. Ignite the top of the test sample and determine the minimum amount of oxygen necessary for sustaining the combustion for at least 3 minutes or over a distance of 50 mm or more, and the amount of nitrogen corresponding to that oxygen flow. The moment the test sample is ignited, fire may flash across the test sample by singeing the nap. In this case, ignite the sample again. The value of LOI is calculated by the following equation:

$$LOI = \frac{\text{amount of } O_2 \text{ necessary to sustain combustion}}{\text{amount of } O_2 \text{ necessary to sustain combustion}} \times 100 + \text{corresponding amount of } N_2$$

According to the process of the present invention, a preoxidized fiber having a tensile strength of about 10 kg/mm$^2$ to about 50 kg/mm$^2$ and a specific gravity of 1.35 to 1.50 is produced. The resulting preoxidized fiber may be used in the form of a tow, short fibers, felt, yarn or fabric. The preoxidized fiber may also be activated to form fibrous active carbon, or carbonized to form carbon fiber, by a known method.

For instance, the preoxidized fiber is activated at 700°-1300° C., preferably 900°-1100° C. in an atmosphere made of steam, carbon dioxide, ammonia, a mixture thereof, a mixture of at least one of these gases with an inert gas such as argon, nitrogen or mixture thereof. The activation is usually effected for 10 seconds to 3 hour until the fibrous active carbon has a specific surface area of about 300 m$^2$/g or more. If necessary, a product having a specific surface area of about 2000 m$^2$/g or more may be produced.

The carbonization to produce carbon fiber is effected in an inert gas atmosphere which is typically nitrogen, argon or a mixture thereof at a temperature of 500° C. or more, preferably between 800° and 1300° C. If necessary, heating at a temperature up to about 2500° C. may be effected.

As described in the foregoing, fibrous active carbon or carbon fiber of high quality can be produced in high yield by using the preoxidized fiber produced according to the process of the present invention.

The invention will now be described in further detail with reference to several examples thereof.

EXAMPLE 1

15 G of a 90% aqueous solution of $H_3PO_4$ was added to 1000 ml of an aqueous solution of PAC (Trade name of basic aluminum chloride: manufactured by Nikkei Kako Co.) containing 11.3 wt% of the Al compound calculated in the form of $Al_2O_3$. After the mixture was refluxed at 105° C. for 3 hours, 20 g of $CaCO_3$ was added to the thus obtained reaction mixture, and then the mixture was filtrated to remove $Ca_3(PO_4)_2$. An aqueous solution containing a salt having the empirical formula $Al_2(OH)_{2.7}(SO_4)_{0.26}(PO_4)_{0.3}Cl_{1.88}$ was obtained. An aquous solution containing the salt was adhered in an amount shown in Table 1 to a tow of 270,000 fiber filaments prepared from a copolymer consisting of 93% by weight of acrylonitrile, 5.5% by weight of methyl acrylate and 1.5% by weight of acrylamide, and having a fineness of 2 denier. Preoxidation in each run was conducted at the maximum temperature at which the fibers could be rendered preoxidation (flame-retardant) in the air with a high degree of stability, and for such a length of time as enabled the fibers to have a specific gravity of 1.42 to 1.45, as shown in Table 1. During each run, the tension of the fibers was so controlled as to permit them to have a shrinkage rate which was equal to 75% of their free shrinkage.

Figure 3:
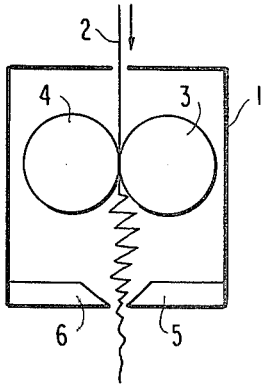
FIG. 3 shows a stuffing box.

The preoxidized fibers were crimped by a stuffing box of the type shown in FIG. 3 at a rate of 100 m/h, a stuffing pressure of 1 kg/cm$^2$ and a nipping pressure of 2 kg/cm$^2$. Referring more specifically to FIG. 3, the fibers 2 were introduced into the stuffing box 1, and nipped by rolls 3 and 4, while a stuffing pressure was applied by metal plates 5 and 6 to the fibers.

TABLE 1

| Run No. | Quantity adhered (wt % of Al) | Properties of preoxidized fibers: Tensile strength (kg/mm$^2$) | Specific gravity | Number of crimps | Crimping ratio (%) | Conditions for preoxidation: Temperature (°C.) | Time (Hr) |
|---|---|---|---|---|---|---|---|
| 1 | 0 | 14.4 | 1.42 | Many tows were broken in the crimper. | | 230 | 15 |
| 2 | 0.03 | 16.5 | 1.42 | 7.2 | 12.5 | 240 | 7 |
| 3 | 0.10 | 26.5 | 1.43 | 8.4 | 14.4 | 245 | 5.5 |
| 4 | 0.51 | 29.4 | 1.44 | 9.1 | 13.1 | 250 | 3.8 |
| 5 | 2.02 | 27.4 | 1.44 | 7.4 | 11.1 | 255 | 3.0 |
| 6 | 6.13 | 12.1 | 1.44 | 6.3 | 2.9 | 263 | 2.8 |
| 7 | 9.85 | 7.5 | 1.45 | 4.6 | 2.8 | 270 | 2.1 |

Notes:
2–5: Invention
Number of crimps: Number in crimped fiber having a length of 25 mm.
Crimping ratio: % of elongation under a load of 2 g/d of crimped fiber having a length of 25 mm.

As is obvious from Table 1, the preoxidized fibers obtained according to this invention were greater in strength, number of crimps and crimping ratio than those obtained without applying the salt, or by causing an excessive quantity of the salt to adhere to the fibers. The fibers of this invention could be subjected to preoxidation at a temperature higher than that at which the fibers to which no salt had been applied could be, and could, therefore, be rendered in a shorter period of time. This is obvious from FIG. 1, too. FIG. 1 shows the specific gravity of the fibers in relation to the time for the preoxidation treatment carried out at a temperature of 230° C. Curve A refers to the fibers of this invention containing 2.02% by weight of the salt in terms of the weight of aluminum, while curve B is directed to the fibers to which no such salt was applied. As is obvious from FIG. 1, the fibers of this invention were higher in specific gravity, and therefore, in flame retardancy when they had both been subjected to the preoxidation treatment for the same period of time. Thus, the fibers of this invention can be rendered flame retardant in a shorter period of time.

EXAMPLE 2

350 G of HCl(35%), 37 g of $H_2SO_4$ (98%), and 450 ml of water were added to hydrated alumina (150 g as $Al_2O_3$) and the mixture was refluxed at 107° C. for 3 hours to obtain a basic aluminum chloride having the following empirical formula:

$$Al_2(OH)_{2.8}(SO_4)_{0.8}Cl_{1.6}$$

A tow of acrylonitrile fibers prepared from a copolymer consisting of 8.4% by weight of methyl acrylate, 1% by weight of sodium allylsulfonate and 90.6% by weight of acrylonitrile, and having an individual fineness of 3 denier and a total denier of 540,000, a tensile strength of 3.8 g/d and an elongation of 25% was passed through an aqueous solution containing 1% by weight of the above-described salt, and dried at 130° C., whereby there was obtained a tow of absolutely dry fibers carrying 0.1 wt% of Al element. The tow was subjected to preoxidation in the air at 250° C. for an hour and successively at 270° C. for 1.3 hours. During the preoxidation treatment, the fibers were kept under a tension of 0.08 g/d enabling them to have a shrinkage rate equal to 70 to 90% of their free shrinkage at each temperature involved. The two thus obtained was continuously fed through a crimper at a rate of 95 m/h, a nipping pressure of 2 kg/cm$^2$ and a stuffing pressure of 1 kg/cm$^2$ to yield crimped preoxidized fibers. These preoxidized fibers had 15 crimps, a crimping ratio of 8.1%, a tensile strength of 26.5 kg/mm$^2$, an elongation of 18.4% and a specific gravity of 1.45. They were excellently crimped, and had excellent fibrous properties. They were successfully formed into No. 40 yarn by a cotton spinning machine without causing any substantial end breakage.

EXAMPLE 3

13 G of 90% $H_3PO_4$ aqueous solution and 5 g of a 61%$HNO_3$ aqueous solution were added to 1000 ml of an aqueous solution of TAI-PAC 5010 (Trade name of basic aluminum chloride: manufactured by Taimei Kagaku Co.) containing 11.3 wt% of the Al compound calculated in the form of $Al_2O_3$. The thus obtained mixture was refluxed at 107° C. for 5 hours to obtain a product having the following empirical formula:

$$Al_2(OH)_{2.65}(NO_3)_{0.05}(SO_4)_{0.1}(PO_4)_{0.1}Cl_{2.80}$$

A tow of acrylonitrile fibers prepared from a copolymer consisting of 5.0% by weight of methyl acrylate, 1.0% by weight of acrylamide, 1.2% by weight of sodium allylsulfonate and 92.8% by weight of acrylonitrile, and having an individual fineness of 2 denier and a total fineness of 680,000 denier, a strength of 3.9 g/d and an elongation of 29% was passed through a 2 wt% aqueous solution of the above-described Al compound, and dried at 125° C. to yield a tow of absolutely dry fibers carrying 0.2 wt% of Al element. The tow was subjected to preoxidation in the air at 245° C. for 30 minutes, successively at 275° C. for two hours and further at 280° C. for 10 minutes. During the preoxidation treatment, the fibers were kept under a tension of 0.05 g/d enabling them to have a shrinkage rate equal to 70 to 90% of their free shrinkage at each temperature involved. The preoxidized fibers thus obtained were continuously fed through a crimper at a rate of 95 m/h, a nipping pressure of 2 kg/cm$^2$ and a stuffing pressure of 1 kg/cm$^2$. The resulting preoxidized fibers had 7.8 crimps, a crimping ratio of 18%, a tensile strength of 29.4 kg/mm$^2$, an elongation of 20.1% and a specific gravity of 1.44. They were excellently crimped, and had excellent fibrous properties.

The preoxidized fibers were treated for a minute under a tension of 0.005 g/d in a nitrogen gas atmosphere having a temperature of 1,000° C. to yield carbon fibers.

They had a crimp number of 4 and a crimping ratio of 5%. They were formed into satisfactory slivers by a cotton spinning card without producing any substantial waste.

EXAMPLE 4

To 80 g of $Al(OH)_3$ powder 280 g of hydrochloric acid (37%) and a 15 g of a 90%$H_3PO_4$ aqueous were added and the mixture were stirred at 100° C. for 1.5 hours. To the thus obtained mixture 50 g of $Al_2(SO_4)_3.18H_2O$ was added and dissolved at 110° C., and then 1000 ml of water and 90 g $CaCO_3$ were added to the mixture. The mixture was refluxed at 105° C. for 2 hours to obtain a water-soluble basic salt of aluminum having the formula $Al_2(OH)_{2.7}Cl_{2.1}(PO_4)_{0.4}$. The Al salt was adhered in an aluminum quantity of 0.05% by weight to fibers of a copolymer consisting of 92% by weight of acrylonitrile and 8% by weight of methyl acrylate, and the fibers were subjected to two steps of oxidation treatment. The results are shown in Table 2 which also shows the products of a conventional process not containing any aluminum compound.

TABLE 2

| | | Oxidation Temp (°C.) × Time (hr) | | Properties of preoxidized fibers | | |
|---|---|---|---|---|---|---|
| | Run No. | 1st step | 2nd step | Crimp number | Crimping ratio | Specific gravity |
| Invention | 1 | 240 × 2 | 260 × 2 | 7.3 | 11.1 | 1.43 |
| | 2 | 245 × 1.5 | 265 × 1.5 | 6.8 | 10.5 | 1.42 |
| | 3 | 250 × 1 | 275 × 0.75 | 4.9 | 8.5 | 1.42 |
| Conventional | 4 | 230 × 3 | 250 × 3 | 4.2 | 2.8 | 1.43 |
| | 5 | 240 × 1 | — | no preoxidized fiber could be obtained because of breakage by combustions. | | |

As is obvious from the results shown in Table 2, the acrylonitrile fibers carrying the water-soluble basic salt of aluminum did not burn despite the high initial temperature, but could be oxidized rapidly to yield preoxidized fibers having a high degree of workability within a period which was less than about a half of the time required for the oxidation of the fibers according to the conventional process.

EXAMPLE 5

200 ml Of 37% hydrochloric acid, 14.4 g of phosphoric acid and 1000 ml of water were added to 50 g of a fine aluminum hydroxide powder. The mixture was heated at 110° C. for 3 hours in an autoclave to prepare an aqueous solution of a basic aluminum salt having the formula $Al_2(OH)_{2.1}Cl_{2.4}(PO_4)_{0.5}$. The solution was appropriately diluted, and a tow of fibers prepared from a copolymer consisting of 94.7% by weight of acrylonitrile and 5.3% by weight of methyl acrylate, and having an individual fineness of 3 denier and a total fineness of 540,000 denier was immersed in the diluted solution at ordinary room temperature to yield fibers carrying the solution in an elemental aluminum quantity of 0.01 to 6.5% by weight as shown in Table 4. These fibers were subjected to oxidation in the air in two steps, i.e., first at 250° C. for an hour and then at 270° C. for 1.5 hours. The thus preoxidized fibers were crimped in the same manner as in Example 1.

For comparison purposes, the same fibers not containing any aluminum compound were similarly treated. The results are shown in Table 3. the oxidized fibers were, then, activated at 910° C. in superheated stream to yield fibrous active carbon having a specific surface area of 900 $m^2/g$. The yield of activation and the properties of activated product are shown in Table 4.

TABLE 3

| Run No. | Aluminum quantity (wt %) | Properties of preoxidized fibers: Crimp number | Specific gravity | Tensile strength ($kg/mm^2$) |
|---|---|---|---|---|
| 1 (Comparative) | 0 | 4.3 | 1.39 | 15.3 |
| 2 (Invention) | 0.01 | 7.6 | 1.39 | 20.1 |
| 3 (Invention) | 0.03 | 8.1 | 1.41 | 26.3 |
| 4 (Invention) | 0.07 | 11.1 | 1.41 | 26.5 |
| 5 (Invention) | 0.53 | 10.9 | 1.41 | 30.2 |
| 6 (Invention) | 1.12 | 9.7 | 1.43 | 28.5 |
| 7 (Invention) | 2.74 | 8.4 | 1.42 | 22.5 |
| 8 (Comparative) | 5.10 | 6.7 | 1.42 | 18.9 |
| 9 (Comparative) | 6.50 | 4.1 | 1.42 | 14.7 |

TABLE 4

| Run No. | Yield of activation (%) | Crimp number | Tensile strength ($kg/mm^2$) |
|---|---|---|---|
| 1 | 18 | 2.8 | 30.3 |
| 2 | 18 | 4.1 | 35.1 |
| 3 | 20 | 6.5 | 38.7 |
| 4 | 23 | 7.3 | 45.8 |
| 5 | 24 | 6.4 | 45.3 |
| 6 | 24 | 7.1 | 40.8 |
| 7 | 22 | 5.3 | 36.9 |
| 8 | 18 | 3.1 | 29.8 |
| 9 | 18 | 2.1 | 25.7 |

As is obvious from the foregoing results, the use of the water-soluble basic aluminum salt enabled a drastic improvement in the preoxidation process and the quality of the preoxidized product, and a high yield of fibrous active carbon.

EXAMPLE 6

A tow of fibers prepared from a copolymer consisting of 91% by weight of acrylonitrile and 9% by weight of methyl acrylate, and having an individual fineness of 3 denier or a total fineness of 560,000 denier was immersed in the same aqueous solution of a basic aluminum salt as that used in EXAMPLE 5, and dried to yield fibers carrying an elemental aluminum quantity of 0.03% by weight. These fibers were oxidized in the air under the conditions set forth in Table 5. The two of oxidized fibers was crimped at a rate of 80 m/h, a nipping pressure of 2 $kg/cm^2$ and a stuffing pressure of 1 $kg/cm^2$, and the crimped fibers were cut to a length of 102 mm. The oxidized staple thus obtained was formed by a nonwoven fabric making machine into oxidized fiber felt having a weight of 500 $g/m^2$.

For comparision purposes, similar treatments were given to comparative fibers of the same composition, but not carrying any aluminum compound.

The properties of the oxidized fibers and the felt prepared therefrom are shown in Table 5. The oxidized fiber felt was activated in steam at 930° C. The yield and properties of the fibrous active carbon felt thus obtained are shown in Table 6. Yield of activation is for production of fibrous active carbon having a specific surface area of 900 $m^2/g$.

TABLE 5

| Run No. | | Oxidizing conditions Temp.(°C.) × Time(Hr) 1st Stage | 2nd Stage | Properties of oxidized fibers: Number of crimps | Specific gravity | Felt strength Longitudinal | Transverse | Yield of felting (%) |
|---|---|---|---|---|---|---|---|---|
| Invention | 1 | 225 × 2 | 245 × 3 | 11.7 | 1.42 | 2.10 | 1.83 | 95 |
| | 2 | 230 × 2 | 250 × 2 | 10.9 | 1.41 | 2.05 | 1.72 | 95 |
| | 3 | 235 × 1 | 255 × 1.5 | 9.5 | 1.40 | 1.87 | 1.66 | 90 |
| | 4 | 235 × 1 | 260 × 1 | 8.9 | 1.58 | 1.46 | 1.27 | 90 |
| | 5 | 235 × 0.75 | 265 × 1 | 6.3 | 1.40 | 1.35 | 1.15 | 85 |
| Comparative | 6 | 225 × 2 | 245 × 3 | 5.4 | 1.39 | 0.92 | 0.82 | 80 |
| | 7 | 230 × 2 | 250 × 2 | 4.1 | 1.39 | 0.81 | 0.76 | 70 |
| | 8 | 235 × 1.5 | — | Broken by combustion | — | — | — | — |

TABLE 6

| Run No. | Yield of activation (%) | Felt strength (kg/cm) Longitudinal | Transverse |
|---|---|---|---|
| 15 | 32 | 0.42 | 0.23 |
| 16 | 31 | 0.41 | 0.24 |
| 17 | 30 | 0.33 | 0.21 |
| 18 | 30 | 0.28 | 0.18 |
| 19 | 29 | 0.22 | 0.15 |
| 20 | 26 | 0.15 | 0.08 |
| 21 | 23 | 0.15 | 0.08 |

As is obvious from the foregoing, this invention enables the use of a high temperature for oxidation to permit a reduction in oxidizing time and an elevation in the rate of oxidation, and ensures the excellent crimping of the oxidized fibers to enable the final production of strong fibrous active carbon.

EXAMPLE 7

To 80 g of $Al(OH)_3$ powder 280 g of hydrochloric acid (37%) and 30 g of a 90% $H_3PO_4$ aqueous solution were added. After the mixture was refluxed at 105° C. for 2 hours 60 g of $Al_2(SO_4)_3$ was added and dissolved at 110° C. 1000 ml of water was added to the mixture, and then 100 g of $CaCO_3$ was added therein. The mixture was refluxed at 105° C. for 3 hours and filtrated to obtain a watersoluble basic aluminum salt having the formula $Al_2(OH)_{2.8}Cl_{1.7}(PO_4)_{0.5}$. The salt was adhered in an aluminum quantity of 0.2% by weight to a tow of 280,000 fibers prepared from a copolymer consisting of 92% by weight of acrylonitrile and 8% by weight of vinyl acetate, and having a fineness of 2 denier. The two was oxidized continuously at 245° C. for 1.5 hours and at 265° C. for two hours, and the oxidized fibers were delivered to a crimper where they were crimped in the same manner as in EXAMPLE 1. The crimped oxidized fibers had a crimp number of 13.8, a tensile strength of 26.3 kg/mm$^2$, an elongation of 15.6% and a specific gravity of 1.41. They were excellently crimped, and had excellent fibrous properties. The oxidized fibers were, then, treated in steam at 900° C. for 10 minutes to produce good fibrous active carbon having a specific surface area of 1,000 m$^2$/g, a tensile strength of 25.8 kg/mm$^2$ and a crimp number of 6.3 with an activation yield of 25%.

For comparison purposes, $AlCl_3$ was caused to adhere in an equal aluminum quantity of a tow of fibers of the same composition, and the fibers were oxidized and crimped under the same conditions. The oxidized fibers thus obtained had a crimp number of 4.1, a tensile strength of 10.2 kg/mm$^2$, an elongation of 8.2% and a specific gravity of 1.39. No improvement could be achieved in the workability of the fibers or their oxidizing time. The fibers were activated under the same conditions to produce fibrous active carbon with an activated yield of 23%. They had a specific surface area of 900 m$^2$/g, a tensile strength of 15.1 kg/mm$^2$ and a crimp number of 3.8. They were, thus, inferior to the products of this invention in all of those respects.

EXAMPLE 8

A tow of acrylonitrile fibers prepared from a copolymer consisting of 94.0% by weight of acrylonitrile and 6.0% by weight of methyl acrylate, and having an individual fineness of 1.5 denier and a total fineness of 300,000 denier, a tensile strength of 25 kg/mm$^2$ and an elongation of 37% was placed in a solution of the aluminum salt used in EXAMPLE 5, ferric sulfate and orthophosphoric acid containing 0.02 wt% of elemental aluminum, 0.004 wt% of elemental iron and 0.017 wt% of elemental phosphorous to yield a tow of acrylonitrile fibers carrying 0.022 wt% of elemental aluminum, 0.0044 wt% of elemental iron and 0.019 wt% of elemental phosphorous. The tow was oxidized in an atmosphere containing 20% by volume of oxygen at 235° C. for two hours, and in an atmosphere containing 8% by volume of oxygen at 255° C. for two hours under a tension allowing the fibers to have a shrinkage percentage equal to 40% of their free shrinkage until the specific gravity became 1.22, and a shrinkage percentage equal to 75 to 80% of their free shrinkage thereafter.

The preoxidized fibers thus obtained showed a LOI of 55, a tensile strength of 36 kg/mm$^2$ and an elongation of 34%. The preoxidized fibers were, then, crimped by the method described in EXAMPLE 5 so that they might have a crimp number of 44 and a crimping ratio of 34%, and the crimped fibers were cut to a length of 51 mm. They were subjected to a spinning test, and their damage and short fiber content were as follows:

| | |
|---|---|
| Fiber damage ratio | 6.4% |
| Short fiber content | 1.2% |

The damage ratio was calculated by the following equation in accordance with a staple diagram obtained by weighing 20 g of staples having a cut length of 51 mm, placing them in a sample card (DAIWA KIKO Model SC-200) 10 times repeatedly and sorting the resulting web length:

$$\text{Fiber damage ratio (\%)} = \frac{\text{Average fiber length of raw stock} - \text{Average fiber length after card test}}{\text{Average fiber length of raw stock}} \times 100$$

The short fiber content was obtained from a similar staple diagram, and is the percentage of short fibers having a length not larger than a half of the average fiber length of the raw stock.

EXAMPLE 9

Preoxidized fibers were prepared by oxidation in accordance with the procedures of EXAMPLE 8 except that different quantities of elemental aluminum, iron and phosphorous were caused to adhere to the acrylonitrile fibers as shown in Table 7. The preoxidized fibers were subjected to the same spinning tests as had been conducted in EXAMPLE 8. The results are shown in Table 7.

TABLE 7

| Run No. | Al (wt %) | Fe (wt %) | P (wt %) | Properties of preoxidized fibers: LOI | Tensile strength (kg/mm²) | Tensile elongation (%) | Spinning Test: Fiber damage ratio (%) | Short fiber content (%) |
|---|---|---|---|---|---|---|---|---|
| 1 | 0 | 0 | 0 | 52 | 24 | 14 | 39 | 21 |
| 2 | 0 | 0 | 0.0352 | 56 | 31 | 17 | 31.5 | 19.5 |
| 3 | 0 | 0.0026 | 0 | 54 | 29 | 17 | 31.0 | 19.0 |
| 4 | 0 | 0.0026 | 0.0352 | 56 | 30 | 16 | 29.4 | 18.4 |
| 5 | 0.0204 | 0 | 0 | 55 | 31 | 18 | 24.4 | 18.4 |
| 6 | 0.0204 | 0.0026 | 0 | 55 | 34 | 18 | 23.9 | 14.6 |
| 7 | 0.0204 | 0 | 0.0352 | 56 | 29 | 16 | 24.1 | 18.1 |
| 8 | 0.0204 | 0.0026 | 0.0165 | 61 | 37 | 35 | 9.4 | 1.3 |
| 9 | 0.0204 | 0.0039 | 0.0352 | 65 | 37 | 37 | 9.1 | 1.6 |
| 10 | 0.0204 | 0.0072 | 0.0352 | 65 | 32 | 34 | 10.0 | 1.8 |
| 11 | 0.0660 | 0 | 0 | 55 | 34 | 15 | 24.1 | 15.1 |
| 12 | 0.0660 | 0.0026 | 0 | 55 | 31 | 17 | 23.1 | 14.2 |
| 13 | 0.0660 | 0.0200 | 0 | 55 | 30 | 13 | 24.5 | 14.5 |
| 14 | 0.0660 | 0.0026 | 0.0671 | 65 | 29 | 12 | 22.2 | 17.4 |

Runs Nos. 8, 9 and 10: The present invention

EXAMPLE 10

Figure 4:
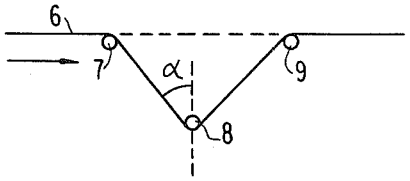
FIG. 4 shows a method of measuring the bending angle of fibers.

A tow of fibers prepared from a copolymer consisting of 92% by weight of acrylonitrile, 6% by weight of methyl acrylate and 2% by weight of acrylamide, and having an individual fineness of 1.5 denier and a total fineness of 450,000 denier was treated with a mixed solution of the aluminum salt used in EXAMPLE 5, ferric chloride and hypophosphorous acid to prepare a tow carrying 0.02 wt% of aluminum element, 0.003 wt% of iron element and 0.025 wt% of phosphorous element and a tow carrying 0.021 wt% of aluminum element, 0.08 wt% of iron element and 0.01 wt% of phosphorous element. These fibers were oxidized in an atmosphere containing 20% by volume of oxygen at 235° C. for two hours under a tension allowing the fibers to have a shrinkage rate equal to 40% of their free shrinkage until the specific gravity became 1.21, and bent at an angle of 30° (see FIG. 4, 6 shows the tow, 7, 8 and 9 show rollers and $\alpha$ shows a bent angle), and oxidized again in an atmosphere containing 7% by volume of oxygen at 255° C. for 0.5, 1.0 or 2 hours under a tension allowing the fibers to have a shrinkage rate equal to 75% of their free shrinkage, whereby preoxidized fibers having different LOI values were obtained. These fibers were subjected to a spinning test.

TABLE 8

| Quantity adhered: Al | Fe | P wt % | Oxidizing time | Preoxidized Fibers: LOI | Tensile strength (kg/mm²) | Elongation (%) | Spinning Test: Fiber damage (%) | Short fiber content (%) |
|---|---|---|---|---|---|---|---|---|
| 0.020 | 0.003 | 0.250 | 0.5 | 27 | 40 | 41 | 74 | 3.2 |
| | | | 1.0 | 46 | 39 | 42 | 91 | 1.4 |
| | | | 2.0 | 54 | 35 | 39 | 95 | 1.6 |

TABLE 8-continued

| Quantity adhered: Al | Fe | P wt % | Oxidizing time | Preoxidized Fibers: LOI | Tensile strength (kg/mm²) | Elongation (%) | Spinning Test: Fiber damage (%) | Short fiber content (%) |
|---|---|---|---|---|---|---|---|---|
| 0.021 | 0.080 | 0.010 | 0.5 | 26 | 32 | 31 | 11.2 | 2.5 |
| | | | 1.0 | 35 | 19 | 19 | 27.4 | 17.5 |
| | | | 2.0 | 60 | 16 | 13 | 29.3 | 16.4 |

EXAMPLE 11

A tow of fibers prepared from a copolymer consisting of 92% by weight of acrylonitrile and 8% by weight of methyl acrylate, and having an individual fineness of 1.5 denier and a total fineness of 300,000 denier was treated with a mixed aqueous solution of the aluminum salt used in EXAMPLE 7, ferric sulfate and phosphorous acid containing 0.02 wt% of elemental aluminum, 0.004 wt% of elemental iron and 0.02 wt% of elemental phosphorous to prepare fibers carrying 0.022 wt% of elemental aluminum, 0.0044 wt% of elemental iron and 0.022 wt% of elemental phosphorous. The fibers were oxidized in the air at 235° C. for two hours, drawn by bending at an angle of 30°, and oxidized again at 255° C. for two hours under a tension allowing the fibers to have a shrinkage rate equal to about 77% of their free shrinkage, whereby preoxidized fibers having an LOI of 60, a tensile strength of 35 kg/mm² and an elongation of 39% were obtained. The oxidized fibers were placed in a tow reactor for roving and fine spinning to provide oxidized yarn having a fineness of 1,700 denier, a twist coefficient of 44 and a final to original twist ratio of 0.62. The yarn was activated in steam having a temperature of 1,050° C. at a furnace pressure of 0.005 kg/mm² to yield fibrous active carbon two-ply yarn having a specific surface area of 1,050 m²/g and a fineness of 300 denier. The yarn had a strength of 45 g/d and an elongation of 36%, and was free from any appreciable fluff and breakage. The twist coefficient is expressed by the following formula:

$$\text{Twist coefficient (two-ply yarn)} = \frac{\text{Number of twists per meter}}{\sqrt{\text{Metric count}}}$$

EXAMPLE 12

One liter of a 1 mol/l of $AlCl_3$ aqueous solution was used as catholyte, 1 liter of 1.5 mol/l of $H_2SO_4$ was used as anolyte and an intermediate bath containing 10 liters of a 1 mol/l of $AlCl_3$ aqueous solution was used for producing a basic aluminum chloride. 3 A direct current was used for conducting electrolysis to obtain the chloride having the empirical formula of $Al_2(OH)_3Cl_3$.

A tow of fibers prepared from a copolymer consisting of 92% by weight of acrylonitrile, 6% by weight of methyl acrylate and 2% by weight of acrylamide, and having an individual fineness of 3 denier and a total fineness of 450,000 denier was treated with an aqueous solution of the above-described Al salt to adhere the salt to the fiber in an amount 0.021 wt%. The treated tow was oxidized in the air at 235° C. for two hours under a tension such that the fibers shrink 40% of the free shrinkage to obtain fibers having a specific gravity of 1.22. Thereafter the fibers were subjected to a bent treatment at an angle of 30°. The thus obtained fibers were further oxidized in the air at 260° C. for two hours under a tension such that the fibers shrink 75% of the free shrinkage. The resulting preoxidized fibers had 55 of LOI, 26 kg/mm$^2$ of tensile strength and 19% of tensile elongation.

EXAMPLE 13

The same tow as in Example 12 was treated with a mixed solution of the aluminum salt prepared in Example 12, ferric sulfate and orthophosphoric acid to prepare fibers carrying 0.018 wt% of aluminum, 0.005 wt% of iron and 0.031 wt% of phosphorous. They were oxidized in the air at 235° C. for two hours under a tension allowing the fibers to have a shrinkage rate equal to 40% of their free shrinkage until the specific gravity of the fibers reached 1.21, bent at an angle of 30°, and oxidized again at 260° C. for two hours under a tension causing the fibers to shrink at a rate equal to 75% of their free shrinkage. The flameretardant fibers thus obtained showed an LOI of 56, a tensile strength of 30 kg/mm$^2$ and an elongation of 32%. The flameretardant fibers were treated with steam at 125° C. for 30 minutes, and their elongation was improved to a further extent. They had an LOI of 56, a tensile strength of 35 kg/mm$^2$ and an elongation of 37%.

While the invention has been described in detail and with reference to specific embodiments thereof, it will be apparent to one skilled in the art that various changes and modifications can be made therein without departing from the spirit and scope thereof.

What is claimed is:

1. Acrylonitrile fibers which have been treated with a composition comprising a watersoluble basic aluminum salt of the formula:

$$Al_2(OH)_l(A)_m(B)_n(C)_p(Cl)_q \quad (I)$$

where (1) A, B and C stand for mutually different acid residues;

(2) l and q are both an integer or decimal fraction larger than 0;

(3) m, n and p are 0 or an integer or decimal fraction and make a total which is not zero;

(4) $l+mEm+nEn+pEp+q=6$(Em, En and Ep are the valence numbers of A, B and C, respectively);

$$0.4 \leqq \frac{l}{l+m+n+p+q} \leqq 0.9; \quad (5)$$

so that an amount of 0.005 to 5.0% by weight of elemental aluminum is present in the salt in contact with the fibers based on the weight of the treated fibers.

2. Acrylonitrile fibers as set forth in claim 1, wherein said fibers are composed of a material selected from the group consisting of a homopolymer, a copolymer, a mixture of a homopolymer and a copolymer, or a mixture of copolymers, and containing at least 85% by weight of acrylonitrile.

3. Acrylonitrile fibers as set forth in claim 2, wherein said fibers are composed of acrylonitrile and at least one monomer selected from the group consisting of acrylic acid, methacrylic acid, their salts, esters, acid chlorides, acid amides, and n-substituted derivatives of the acid amides, vinyl chloride, vinylidene chloride, α-chloroacrylonitrile, vinyl pyridine, vinylsulfonic acid, allylsulfonic acid, vinylbenzenesulfonic acid and their alkali metal and alkaline earth metal salts.

4. Acrylonitrile fibers as set forth in claim 1, wherein said acid residues are inorganic acid residues.

5. Acrylonitrile fibers as set forth in claim 1, wherein each of said acid residues is an inorganic acid selected from the group consisting of nitric acid, nitrous acid, sulfuric acid, phosphoric acid and phosphorous acid.

6. Acrylonitrile fibers as set forth in claim 1, wherein said salt of formula I is a salt selected from the group consisting of:

(1) $Al_2(OH)_{2.5}NO_3Cl_{2.5}$;
(2) $Al_2(OH)_5(SO_4)_{0.25}Cl_{0.5}$;
(3) $Al_2(OH)_{2.8}(SO_4)_{0.8}Cl_{1.6}$;
(4) $Al_2(OH)_{2.7}(SO_4)_{0.26}Cl_{2.8}$;
(5) $Al_2(OH)_{2.7}(SO_4)_{0.26}(PO_4)_{0.3}Cl_{1.88}$;
(6) $Al_2(OH)_{2.65}(NO_3)_{0.05}(SO_4)_{0.1}(PO_4)_{0.1}Cl_{2.80}$; and
(7) $Al_2(OH)_3Cl_3$.

7. Acrylonitrile fibers as set forth in claim 1, wherein in said formula I, n and p are 0 and A is $PO_4$.

8. Acrylonitrile fibers as set forth in claim 7, wherein said salt is selected from the group consisting of:

(1) $Al_2(OH)_{2.7}Cl_{2.1}(PO_4)_{0.4}$;
(2) $Al_2(OH)_{2.1}Cl_{2.4}(PO_4)_{0.5}$;
(3) $Al_2(OH)_{2.8}Cl_{1.7}(PO_4)_{0.5}$.

9. Acrylonitrile fibers as set forth in claim 1, wherein said composition further comprises a phosphorous compound and an iron compound in addition to said salt.

10. Acrylonitrile fibers as set forth in claim 9, wherein said salt of formula I is free from any phosphorous element.

11. Acrylonitrile fibers as set forth in claim 9, wherein aluminum in said salt, iron in said iron compound and phosphorous in said phosphorous compound are present in the quantity of 0.005 wt% to 0.05 wt%, 0.005 to 0.01 wt% and 0.005 to 0.1 wt%, respectively, based on the weight of said treated fibers.

12. Acrylonitrile fibers as set forth in claim 9, wherein said phosphorous compound is selected from the group consisting of orthophosphoric acid, hypophosphorous acid and phosphorous acid.

13. Acrylonitrile fibers as set forth in claim 9, wherein said iron compound is selected from the group consisting of ferric chloride, ferric nitrate, ferric sulfate, ferrous chloride, ferrous nitrate and ferrous sulfate.

* * * * *